US008845057B2

(12) United States Patent
Sawase

(10) Patent No.: US 8,845,057 B2
(45) Date of Patent: Sep. 30, 2014

(54) IMAGE FORMING APPARATUS INCLUDING RECORDING HEAD

(75) Inventor: Hiroshi Sawase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 56 days.

(21) Appl. No.: 13/557,678

(22) Filed: Jul. 25, 2012

(65) Prior Publication Data

US 2013/0033536 A1 Feb. 7, 2013

(30) Foreign Application Priority Data

Aug. 3, 2011 (JP) ..... 2011-170489

(51) Int. Cl.
*B41J 29/38* (2006.01)
*B41J 2/165* (2006.01)
*B41J 3/60* (2006.01)

(52) U.S. Cl.
CPC ..... *B41J 3/60* (2013.01); *B41J 2/16526* (2013.01); *B41J 2/16579* (2013.01)
USPC ..... 347/14; 347/5; 347/9; 347/19

(58) Field of Classification Search
CPC ..... B41J 29/38
See application file for complete search history.

(56) References Cited

U.S. PATENT DOCUMENTS 5,500,657 A * 3/1996 Yauchi et al. ..... 347/9
7,108,348 B2 * 9/2006 Shinkawa et al. ..... 347/19
7,597,417 B2 * 10/2009 Nagashima ..... 347/19
2007/0211092 A1 * 9/2007 Shingyohuchi et al. ..... 347/10
2009/0058907 A1 * 3/2009 Umeda ..... 347/14
2009/0147034 A1 * 6/2009 Yoshida ..... 347/10

FOREIGN PATENT DOCUMENTS

JP 2005-144767 6/2005
JP 2005-280351 10/2005
JP 2006-110774 4/2006
JP 2007-118264 5/2007

* cited by examiner

*Primary Examiner* — Manish S Shah
*Assistant Examiner* — Jeremy Delozier
(74) *Attorney, Agent, or Firm* — Cooper & Dunham LLP

(57) ABSTRACT

An image forming apparatus includes a plurality of nozzles to discharge liquid droplets; a recording head including a pressure generator to generate a pressure to cause the nozzles to discharge liquid droplets; a droplet discharge status sensor unit to detect a droplet discharging status from each nozzle; and a maintenance controller to control a maintenance operation by a dummy discharge of liquid droplets not contributing to image formation. In such an image forming apparatus, the droplet discharge status sensor unit compares a detection result of the droplet discharge status and a preset reference threshold and determines whether the nozzle discharges normally or defectively; and the maintenance controller outputs a dummy discharge drive waveform corresponding to a difference between the detected droplet discharge status and the reference threshold to the pressure generator of the nozzle determined to be defective to cause the nozzle to discharge droplets for dummy discharging.

8 Claims, 16 Drawing Sheets

IMAGE FORMING APPARATUS INCLUDING RECORDING HEAD

CROSS-REFERENCE TO RELATED APPLICATION

The present application claims priority from Japanese patent application number 2011-170489, filed on Aug. 3, 2011, the entire contents of which are incorporated by reference herein.

BACKGROUND OF THE INVENTION

1. Field of the Invention

The present invention relates to an image forming apparatus, and in particular to an image forming apparatus including a recording head and a sensor to detect an ink droplet discharging status of the recording head.

2. Description of the Related Art

As an image forming apparatus such as a printer, a facsimile machine, a copier, a plotter, and a multifunction apparatus combining several of the capabilities of the above devices, for example, an inkjet recording apparatus is known which employs a droplet discharging recording method to discharge ink droplets in image formation.

In such an image forming apparatus, because the recording head discharges ink from nozzles to perform image formation on a sheet of paper, an increase in the viscosity of the ink due to evaporation of the ink solvent from the nozzles, agglomeration of the ink, adhesion of foreign particles, or bubbles may cause defective discharge, thereby degrading image quality.

JP-2007-118264-A discloses an inkjet recording apparatus including a droplet discharge status sensor unit to detect a droplet discharge status from the head, in which when a defective nozzle is detected, recording head maintenance is performed. In the detection of the droplet discharge status, JP-2005-280351-A and JP-2006-110774-A each disclose a method of measuring liquid droplet volume or liquid droplet speed.

As maintenance of the recording head, there are the following methods. Suction method to forcibly suck and discharge a liquid from the nozzle by capping the nozzle surface of the recording head by a cap and driving a suction means connected to the cap; pressurizing method to supply liquid from an ink supply to the recording head under pressure to cause the liquid to be pressed and discharged from the nozzle; and a method combining both of the first two methods. In either case, performing recording head maintenance requires liquid consumption not contributive to image formation.

Accordingly, in maintenance to be performed when any abnormal discharge is detected by the droplet discharge status sensor unit, the liquid is discharged from nozzles capable of properly discharging droplets, resulting in unnecessary consumption of liquid.

BRIEF SUMMARY OF THE INVENTION

To solve the aforementioned problems, the present invention provides an improved inkjet recording apparatus capable of minimizing waste liquid ink amount in maintenance following the defective liquid droplet discharge.

In particular, an optimal image forming apparatus includes: a plurality of nozzles configured to discharge liquid droplets; a recording head including a pressure generator to generate a pressure to cause the nozzles to discharge liquid droplets; a droplet discharge status sensor unit to detect a droplet discharging status from each nozzle of the recording head; and a maintenance controller to control a maintenance operation by a dummy discharge of liquid droplets not contributing to image formation. In such an image forming apparatus, the droplet discharge status sensor unit compares a detection result of the droplet discharge status and a preset reference threshold and determines whether the nozzle is a normally discharged nozzle or defectively discharged nozzle; and the maintenance controller outputs a dummy discharge drive waveform corresponding to a difference between the detected droplet discharge status and the reference threshold to the pressure generator of the nozzle determined to be a defectively discharged nozzle to cause the defectively discharged nozzle to discharge droplets for dummy discharging.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Figure 1:
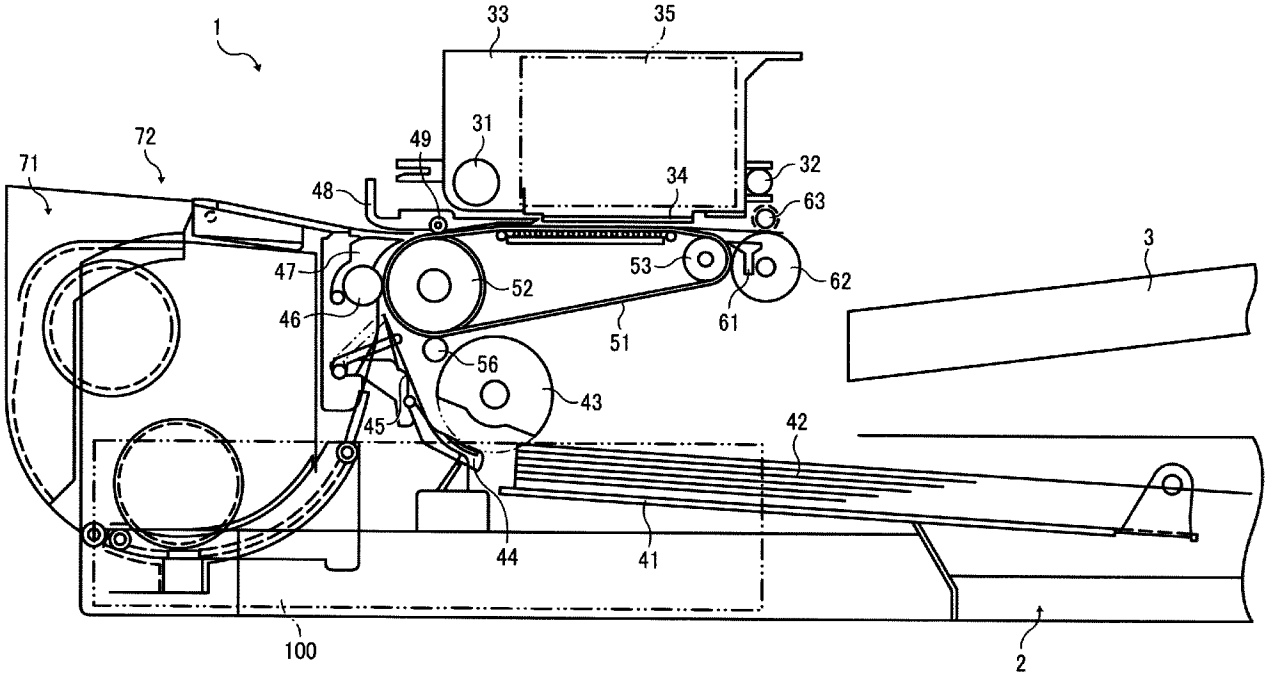
FIG. 1 is a side view of an image forming apparatus illustrating an overall configuration thereof according to an embodiment of the present invention.
Figure 2:
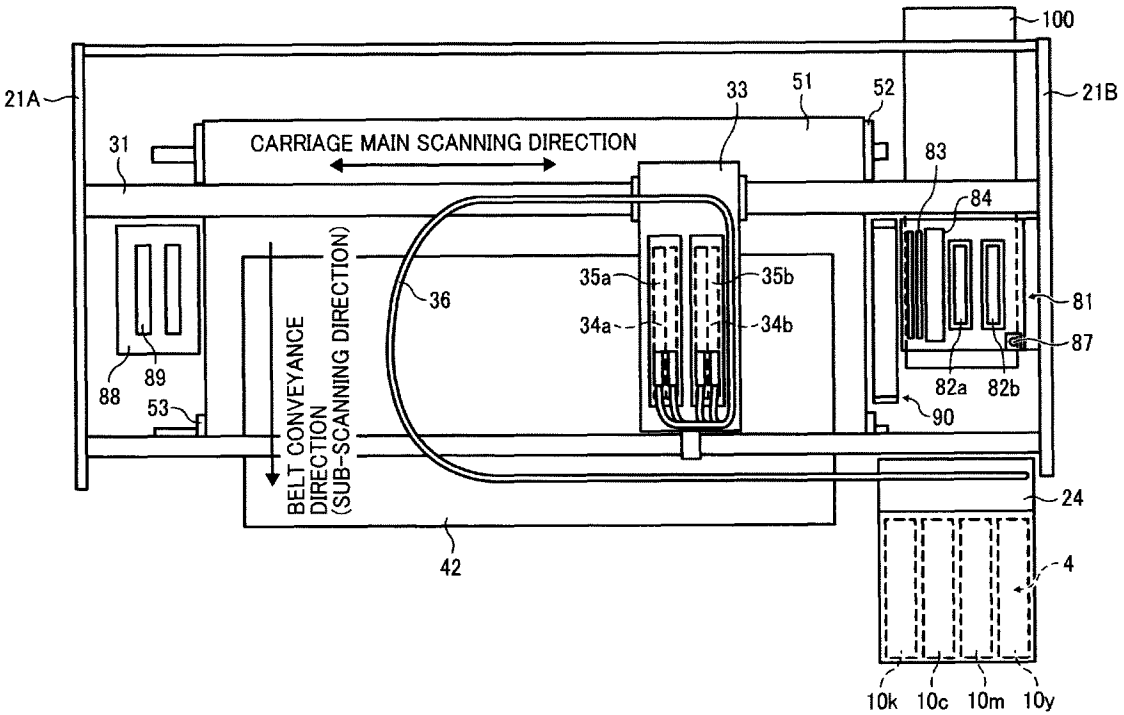
FIG. 2 is a schematic plan view of the image forming apparatus in FIG. 1.

Hereinafter, preferred embodiments of the present invention will now be described with reference to the accompanying drawings. First, an example of an image forming apparatus according to the present invention will be described with reference to FIGS. 1 and 2. FIG. 1 is a side view of the image forming apparatus illustrating an entire structure thereof and FIG. 2 is a plan view of a main part of the image forming apparatus of FIG. 1 illustrating a general configuration thereof.

In the present embodiment, the image forming apparatus is a serial-type inkjet recording apparatus, including a main body 1, side plates 21A and 21B disposed at lateral sides of the body 1, main and sub guide rods 31 and 32 horizontally mounted on the lateral side plates 21A and 21B, and a carriage 33 held by the guide rods 31 and 32 and slidably movable in a main scanning direction by a main scanning motor, to be described later, via a timing belt.

Recording heads 34, mounted on the carriage 33, include bifurcated recording heads 34*a*, 34*b* (collectively referred to as the recording heads 34). The recording heads 34 are formed of liquid discharging heads to discharge ink droplets of yellow (Y), cyan (C), magenta (M), and black (K) colors, respectively, and include nozzle arrays formed of a plurality of nozzles arranged in a sub-scanning direction perpendicular to the main scanning direction, with the ink droplet discharging direction oriented downward.

The recording heads 34 each include two nozzle arrays. One of the nozzle arrays of the recording head 34*a* discharges droplets of black (K) and the other discharges droplets of cyan (C) ink. One of the nozzle arrays of the recording head 34*b* discharges droplets of magenta (M) and the other discharges droplets of yellow (Y) ink, respectively.

The carriage 33 includes head tanks 35*a*, 35*b* (collectively referred to as head tanks 35), which supply ink of respective colors corresponding to each of the nozzle arrays of the recording heads 34. The head tanks 35 are used to supply ink of respective colors by a supply pump unit 24 via a supply tube 36 for each color from ink cartridges 10*y*, 10*m*, 10*c*, and 10*k*, each of which is a main liquid container detachably mounted to a cartridge mount portion 4.

There is provided a sheet feeding portion from which sheets 42 piled on a sheet piling portion (pressure plate) 41 of a sheet feed tray 2 are conveyed. The sheet feeding portion includes a sheet feed roller 43 to separate and feed sheets 42 from the sheet piling portion 41 one by one and a separation pad 44 facing the sheet feed roller 43 and formed of a material having a high friction coefficient. The separation pad 44 is pressed against the sheet feed roller 43.

Then, in order to send the sheet 42 fed from the sheet feed portion to the lower side of the recording head 34, a guide member 45 to guide the sheet 42, a counter roller 46, a conveyance guide member 47, a pressure member 48 including an end press roller 49, and a conveyance belt 51, a conveying means to electrostatically attract the fed sheet 42 and convey it at a position facing the recording heads 34 are disposed.

The conveyance belt 51 in the present embodiment is an endless belt stretching over a conveyance roller 52 and a tension roller 53, and is so configured as to rotate in a belt conveyance direction (i.e., a sub-scanning direction). In addition, a charging roller 56, which is a charging means to charge a surface of the conveyance belt 51, is provided. The charging roller 56 is disposed in contact with the surface layer of the conveyance belt 51 and is rotated by the rotation of the conveyance belt 51. The conveyance belt 51 is rotated in a belt conveyance direction by the rotation of the conveyance roller 52 driven by a sub-scanning motor, which will be described later.

Further, as a sheet ejection portion to eject the sheet 42 recorded by the recording heads 34, a separation claw 61 to separate a sheet 42 from the conveyance belt 51, a sheet discharge roller 62, and a spur 63 being a sheet discharge roller are provided. A sheet discharge tray 3 is provided underneath the sheet discharge roller 62.

A duplex unit 71 is provided detachably at a backside of the apparatus body 1. This duplex unit 71 pulls in a sheet 42 which has been returned by a reverse rotation of the conveyance belt 51, reverses the sheet 42, and feeds the reversed sheet 42 again between the counter roller 46 and the conveyance belt 51. An upper surface of the duplex unit 71 is used as a manual sheet feed tray 72.

A maintenance mechanism 81 to maintain the nozzles of the recording heads 34 in good condition is provided at a non-print area at one side in the scanning direction of the carriage 33. The maintenance mechanism 81 includes: cap members 82*a*, 82*b*; a wiper blade 83; a first dummy discharge receiver 84; and a carriage lock 87 to lock the carriage 33. The cap members 82*a*, 82*b* are provided to cap the nozzle surfaces of the recording heads 34 and are simply referred to as a cap 82 if it is not necessary to distinguish the cap members. The wiper blade 83 is a blade member to wipe the nozzle surfaces. The first dummy discharge receiver 84 receives droplets which are not used for the recording when performing a dummy discharge operation in order to discharge agglomerated recording liquid not contributing to a normal recording operation. Further, in the bottom of the maintenance mechanism 81 of the recording head, a waste tank 99 to contain waste liquid generated by the maintenance operation is replaceably attached to the apparatus body.

A droplet discharge status detection unit 90 configured to detect a droplet discharge status from nozzles of the recording head 34 is disposed between the maintenance mechanism 81 and the conveyance belt 51 and detects a droplet discharge status at a predetermined interval.

Further, a second dummy discharge receiver 88 is disposed at a non-print area opposite the first dummy discharge receiver 84 in the scanning direction of the carriage 33. The second dummy discharge receiver 88 receives droplets of recording liquid when performing a dummy discharge operation in which recording liquid having an increased viscosity during recording and not contributing to the recording is discharged. The second dummy discharge receiver 88 includes openings 89 aligned in the nozzle array direction of the recording heads 34.

In the thus-configured image forming apparatus, the sheets 42 are separated and fed one by one from the sheet feed tray 2, the sheet 42 fed upward in a substantially vertical direction is guided by the guide member 45, and is conveyed while being sandwiched between the conveyance belt 51 and the counter roller 46. The leading edge of the sheet 42 is then guided by the conveyance guide member 47 and is pressed against the conveyance belt 51 by the end press roller 49 to change the conveyance direction by 90 degrees.

At that time, an alternating voltage, which is an alternating repetition of positive and negative voltages, is applied to the charge roller 56. Thus, the conveyance belt 51 is charged in an alternating charge pattern, in which a positive charge and a negative charge are alternately applied across strips with predetermined widths in the sub-scanning direction, which is the direction of rotation of the conveyance belt 51. When the sheet 42 is fed on the thus-alternately-charged conveyance belt 51, the sheet 42 is attracted to the conveyance belt 51 and is conveyed in the sub-scanning direction by the rotation of the conveyance belt 51.

Then, the recording heads 34 are driven in response to image signals while moving the carriage 33 so as to discharge ink droplets onto the stopped sheet 42 to record a single line. After the sheet 42 is conveyed a predetermined distance, recording of a next line is performed. Upon reception of a recording end signal or a signal indicating that a trailing edge of the sheet 42 has reached the recording area, the recording operation is terminated and the sheet 42 is discharged to the sheet discharge tray 3.

When maintenance of the recording heads 34 are performed, the carriage 33 is moved to a home position opposite the maintenance mechanism 81 and capped by the cap member 82. Then, maintenance operations such as suction of nozzles and dummy discharge, in which liquid droplets not contributive to the image formation are discharged, are performed, thereby allowing continued formation of quality images by a stable liquid droplet discharge.

Figure 3:
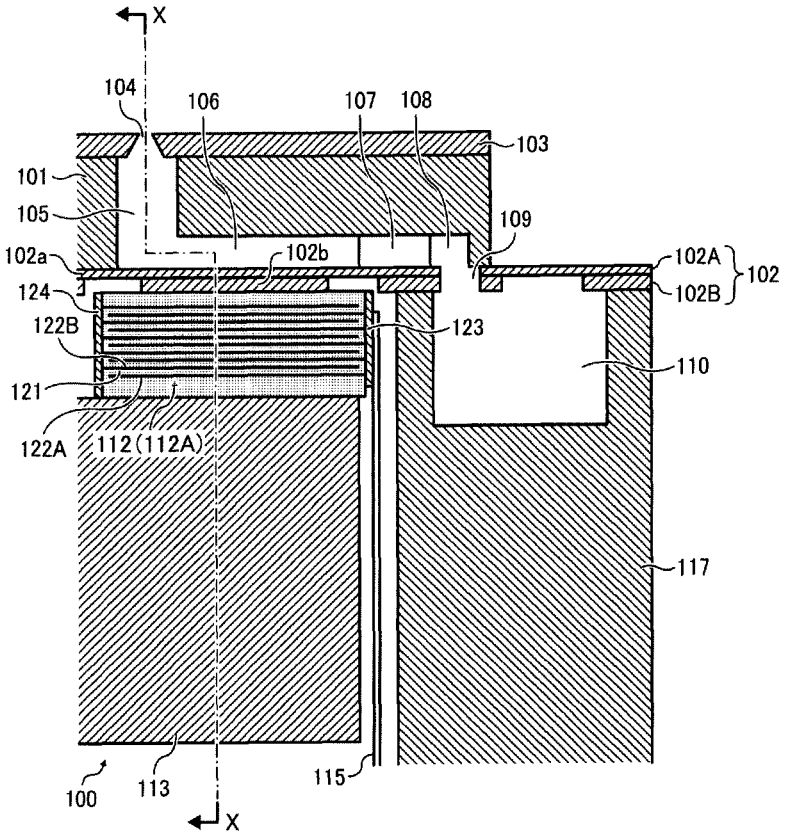
FIG. 3 is a cross-sectional view illustrating an example of a liquid droplet discharge head forming a recording head along a direction perpendicular to a nozzle arrangement direction.
Figure 4:
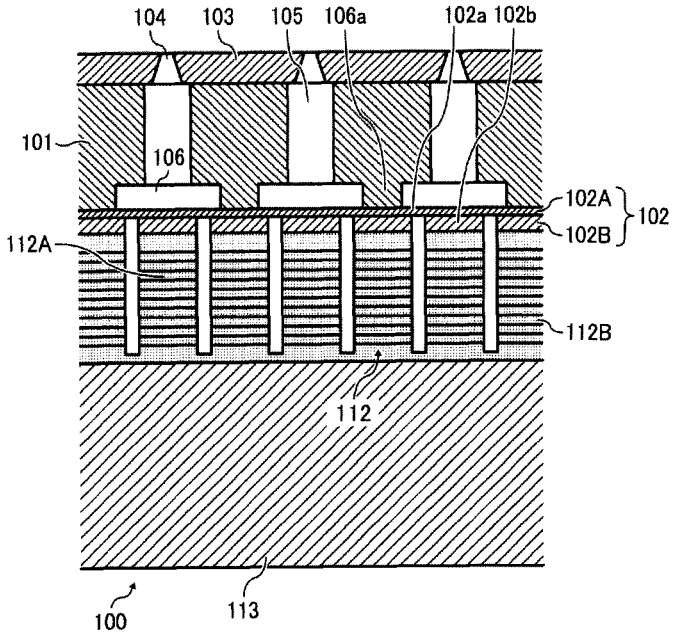
FIG. 4 is a cross-sectional view of a main part of the liquid droplet discharge head taken along X-X line in FIG. 3.

Next, an example of the liquid droplet discharge head forming the recording head 34 in the image forming apparatus will now be described with reference to FIGS. 3 and 4. FIG. 3 is a cross-sectional view of the liquid droplet discharge head along a direction perpendicular to the nozzle arrangement direction of the same head, and FIG. 4 is a cross-sectional view of a main part of the liquid droplet discharge head taken along a line X-X in FIG. 3.

This liquid droplet discharge head includes a flow passage plate (a passage substrate or a liquid chamber substrate) 101; a diaphragm member 102 bonded to a bottom surface of the flow passage plate 101; and a nozzle plate 103 bonded to an upper surface of the flow passage plate 101.

A plurality of nozzles 104 configured to discharge liquid droplets communicates with a plurality of liquid chambers 106 (referred to as a pressurized liquid chamber, a pressurized chamber, or a flow passage) each serving as a flow passage, via a nozzle through-hole passage 105. Further provided are a supply passage 107 to supply ink to the liquid chamber 106 serving also as a fluid resisting part, a through-hole 108 communicating with the liquid chamber 106 via the supply passage 107, a supply port 109 disposed at a diaphragm 102, a common liquid chamber 110 disposed at a frame member 117 (to be described later), in which ink is supplied to the through-hole 108 via the supply port 109 from the common liquid chamber 110.

Here, the flow passage plate 101 is formed such that a monocrystalline silicon substrate having crystal face orientation (110) is subjected to anisotropic etching using alkali etching aqueous fluid such as potassium hydroxide aqueous solution (KOH), to thus form a nozzle through-hole passage 105 and a concave and hollow portion for the liquid chamber 106. The material is not limited to the monocrystalline silicon substrate and other stainless substrates or photosensitive resins can be used. For example, the flow passage plate 101 can be formed such that the SUS substrate is subjected to etching using acidic etching aqueous fluid or mechanical processing such as punching. A dividing wall 106A is disposed between adjacent liquid chambers 106. Each liquid chamber 106 of the flow passage plate 101 is divided by the dividing wall 106A.

The diaphragm member 102 includes a first layer 102A and a second layer 102B thicker than the first layer 102A. The diaphragm member 102 includes a vibration area or a diaphragm 102*a* formed by the first layer 102A. The vibration area 102*a* forms a wall corresponding to each liquid chamber 106. An island-shaped convex portion 102*b* formed of the first layer 102A and the second layer 102B is disposed in the vibration area 102*a* and at an opposite side of the liquid chamber 106. A piezoelectric actuator 100 including an electromechanical transducer as an actuator means causing the vibration area 102*a* to deform or displace is disposed at the island-shaped convex portion 102*b*.

The piezoelectric actuator 100 includes a base member 113 and two layered piezoelectric members 112 laminated on the base member 113 with an adhesive. The piezoelectric member 112 is processed by a half-cut-off singulation so as to have grooves and a predetermined number of piezoelectric pillars 112A and 112B are formed in a sawtooth pattern at predetermined intervals with respect to one piezoelectric member 112. The piezoelectric pillars 112A, 112B of the piezoelectric member 112 are materially the same, differing only in that the piezoelectric pillar which is driven by being supplied with a drive waveform serves as a driven pillar 112A and the piezoelectric pillar which is used only as a pillar is a non-driven pillar 112B.

An upper surface of the driven pillar 112A is laminated on the island-shaped convex portion 102*b* of the diaphragm member 102.

Herein, the piezoelectric member 112 includes a piezoelectric material layer 121 and internal electrodes 122A and I22B, which are alternately laminated one on top of the other. The internal electrodes I 22A and 122B are connected with edge electrodes (external electrodes) 123 and 124 formed on a side wall perpendicular to the diaphragm member 102 of the piezoelectric member 112. When a voltage is applied to the edge electrodes 123 and 124, the piezoelectric member 112 displaces in the layered direction thereof. The external electrode 123 is used as an individual external electrode and the external electrode 124 is used as a common external electrode.

In addition, the piezoelectric member 112 is connected with an FPC 115, a wiring member with flexibility, configured to supply drive signals to the driven pillar 112A. The FPC 115 includes a driver IC to supply drive waveforms to the driven pillar 112A, which is not shown in the figure.

The nozzle plate 103 is formed from nickel plate by, for example, electroplating. Alternatively, the nozzle plates 103 can be formed from other metals such as stainless, resins such as polyimide resin films, and silicon, or a combination selected from those materials. The nozzle plate 103 forms a nozzle 104 with a diameter of from 10 to 35 μm corresponding to each liquid chamber 106, and is bonded to the flow passage plate 101 with an adhesive. A water repellent layer is formed on a liquid droplet discharging side wall of the nozzle plate 103 communicating with the liquid chamber 106.

A frame member 117 is formed using epoxy resins or polyphenylene sulfide which is injection-molded and disposed at an external periphery of the piezoelectric actuator 100 which is formed of the piezoelectric member 112, the base member 113, and the FPC 115. The frame member 117 includes the common liquid chamber 110 and a supply port, not shown, to supply ink from outside to the common liquid chamber 110.

In the thus-configured liquid droplet discharge head, if the voltage to be applied to the driven pillar 112A is lowered from a reference potential Ve depending on the to-be-recorded image, the driven pillar 112A is contracted, the vibration area 102*a* of the diaphragm member 102 is lowered, and a volume of the liquid chamber 106 is expanded. Then, the ink flows into the liquid chamber 106. When the voltage to be applied to the driven pillar 112A is increased, the driven pillar 112A is extended in the layered direction, and the vibration area 102*a* of the diaphragm member 102 is deformed toward the nozzle plate 103, compressing the ink inside the liquid chamber 106 to discharge the recording liquid droplet from the nozzle 104.

When the voltage applied to the driven pillar 112A is returned to the reference potential, the vibration area 102*a* of the diaphragm member 102 returns to an initial position and the liquid chamber 106 is expanded to generate a negative pressure. at this time, the ink is filled in the liquid chamber 106 from the common liquid chamber 110. Then, after vibration of the meniscus surface of the nozzle 104 is damped and stabilized, the operation proceeds to a next liquid droplet discharging.

The head driving method is not limited to the method described above but the liquid droplet discharging may be performed by changing the drive waveform.

Figure 5:
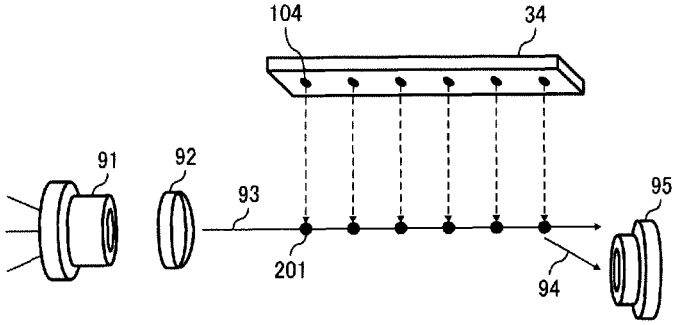
FIG. 5 is an explanatory view illustrating a droplet discharge status sensor unit according to an embodiment of the present invention.

Next, an example of a droplet discharge status sensor unit 90 will now be described with reference to FIG. 5. FIG. 5 is a schematic view illustrating a droplet discharge status sensor unit 90.

This droplet discharge status sensor unit 90 is configured such that a light beam emitted from a laser diode (or a light emitter) 91 is collected via a collimated lens 92 as a laser beam 93, the laser beam 93 is diffused by liquid droplets 201 into a diffused light beam 94, and a photodiode (light receiver) 95 receives the diffused light beam 94 to convert into a voltage and output. Then, the output voltage is compared with a preset reference threshold value, and it is determined if a nozzle which discharges the liquid droplets is normal or abnormal.

Figure 6:
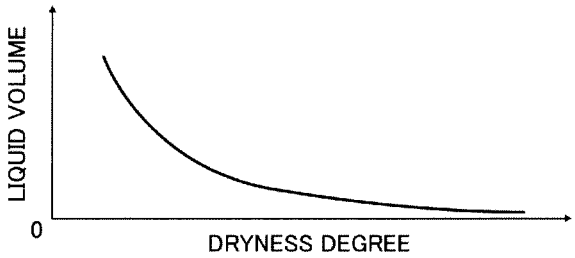
FIG. 6 is a graph illustrating a relation between a dryness degree of ink and a droplet volume.

As illustrated in FIG. 6, as the dryness degree of ink inside the nozzle increases, a droplet volume of the discharged liquid droplet decreases.

Figure 7:
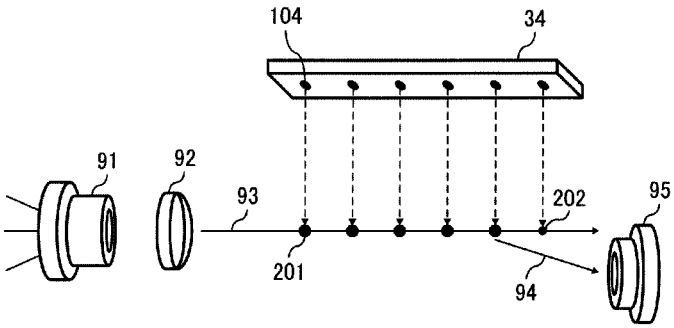
FIG. 7 is an explanatory view illustrating a droplet discharge status.

Then, as illustrated in FIG. 7, when the liquid droplet 20 is sequentially discharged from each nozzle 104 of the recording head 34, for example, it is assumed that the droplet volume of the liquid droplet 202 discharged from a sixth nozzle 104 from the left in FIG. 7 is smaller than a preset volume.

Figure 8:
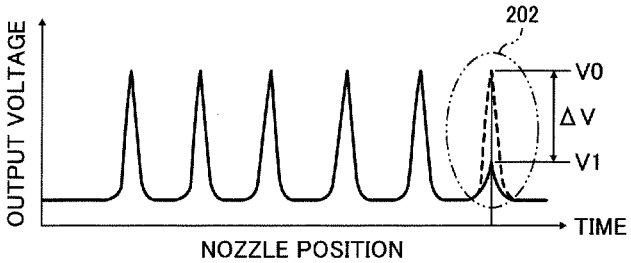
FIG. 8 is a graph illustrating output voltage in the droplet discharge status in FIG. 7.

In this case, output voltage V1 of the photo diode 95 when detecting the liquid droplet 202 from the nozzle 104 is as illustrated by a solid line in FIG. 8. Specifically, the output voltage V1 when the liquid droplet 202 is detected is lower by a difference voltage ΔV from the normal output voltage V0 as indicated by a broken line in FIG. 8.

Herein, the difference voltage ΔV between the actual voltage V1 and the normal output voltage V0 corresponds to a droplet volume, and when the droplet volume is smaller than the preset droplet volume, the difference voltage ΔV becomes greater.

Then, the difference voltage ΔV between the actual output voltage V1 and the normal output voltage V0 is compared with a preset reference threshold preset based on a permissible range of fluctuation in droplet volume, and when the difference voltage ΔV exceeds the preset reference threshold, the discharging status of the nozzle that discharges the corresponding liquid droplet is determined to be abnormal. When the difference voltage ΔV is within the preset reference threshold, the nozzle discharging status is determined to be normal.

Figure 9:
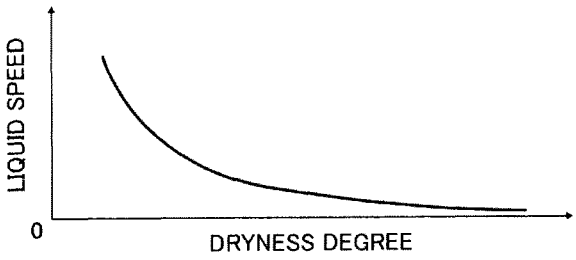
FIG. 9 is a graph illustrating a relation between a dryness degree of ink and a droplet volume.

Moreover, as illustrated in FIG. 9, as the dryness degree of ink inside the nozzle increases, a droplet speed of the discharged liquid droplet decreases.

Figure 10:
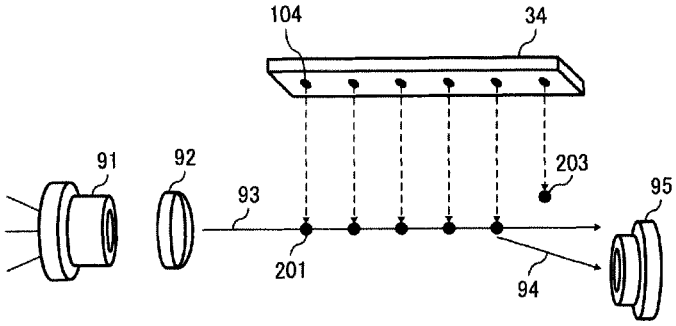
FIG. 10 is an explanatory view illustrating a droplet discharge status.

Then, as illustrated in FIG. 10, when the liquid droplet 201 is sequentially discharged from each nozzle 104 of the recording head 34, for example, it is assumed that the droplet speed of the liquid droplet 203 discharged from a sixth nozzle 104 from the left in FIG. 10 is slower than a preset droplet speed.

Figure 11:
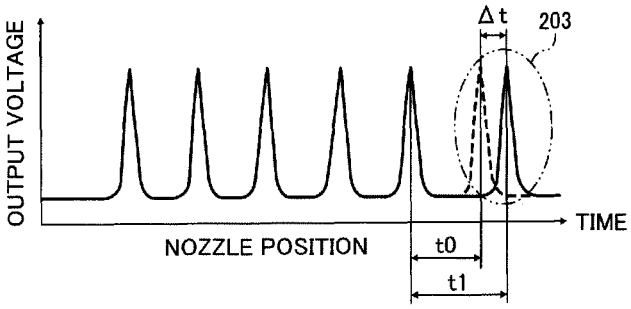
FIG. 11 is a graph illustrating output voltage in the droplet discharge status in FIG. 10.

In this case, output voltage for detecting droplets of the photo diode 95 when detecting the liquid droplet 203 from the nozzle 104 is illustrated by a solid line in FIG. 11. Specifically, a detection interval t1 when the liquid droplet 203 is detected is slower by a difference time At than a normal detection interval t0 to detect an adjacent output voltage as indicated by a broken line in FIG. 11.

Herein, the difference time Δt between the actual interval t1 and the normal detection interval t0 corresponds to a droplet speed, and, when the droplet speed is slower than the preset droplet speed, the difference time Δt becomes longer.

Then, the difference time Δt between the actually detected interval t1 and the normal detection interval t0 is compared with a preset reference threshold based on a permissible range of fluctuation in droplet speed, and, when the difference time Δt exceeds the preset reference threshold, the discharging status of the nozzle that discharges the corresponding liquid droplet is determined to be abnormal, and, when the difference time Δt is within the preset reference threshold, the nozzle discharging status is determined to be normal.

It is to be noted that the structure of the droplet discharge status sensor unit 90 is not limited to the above. Moreover, it is to be noted that the non-discharging of the nozzle may be caused by clogging of the nozzle by foreign particles such as paper dust from outside the nozzle with extended use, or by ingredients included in the ink from inside of the nozzle.

Figure 12:
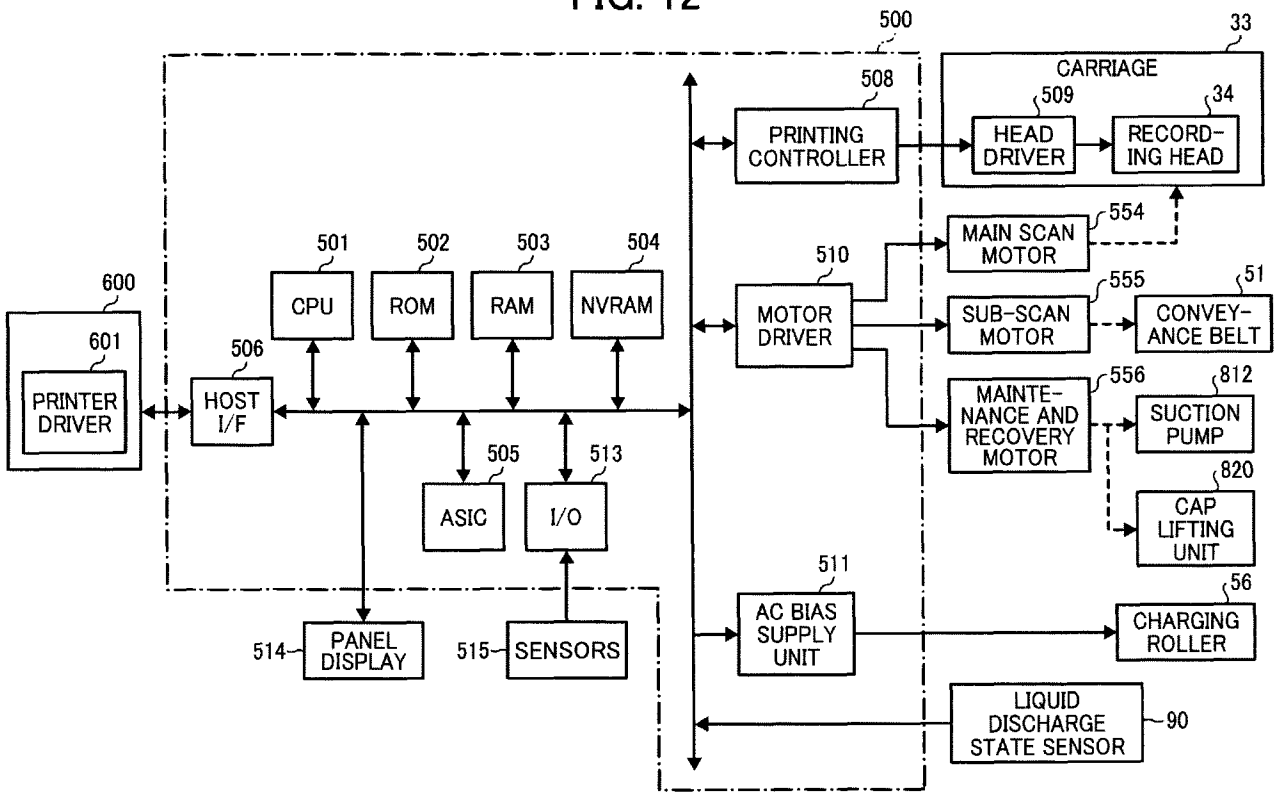
FIG. 12 is a block diagram illustrating a general outline of a controller of the image forming apparatus.

Next, an outline of the controller in the image forming apparatus will now be described with reference to FIG. 12. FIG. 12 is an overall block diagram of the controller 500.

The controller 500 serves to control the apparatus as a whole and includes a CPU 501; various programs executed by the CPU 501; a read-only memory (ROM) 502 storing various fixed data; a random access memory (RAM) 503 temporarily storing image data; a rewritable nonvolatile memory 504 capable of retaining data when power to the apparatus is shut down; and an ASIC 505 configured to handle various signals to the image data, image processing to perform rearrangement and the like, and input/output signals to control the entire apparatus. The various programs include a program to control maintenance operations such as a dummy discharge operation according to the present invention.

The controller 500 further includes a data transmitter to drive and control the recording head 34; a print controller 508 including a drive signal generator; a head driver or driver IC 509, disposed on the carriage 33, to drive the recording head 34; a main scanning motor 554 to move the carriage 33 to scan; a sub-scanning motor 555 to move to circulate the conveyance belt 51; a suction pump 812 of the maintenance mechanism 81; a motor driver 510 to drive a motor 556 which drives a cap lifting mechanism 820 to raise and lower a cap 82; and an AC bias power supply 511 to supply an AC bias to the charging roller 56.

In addition, a control panel 514 for inputting necessary information to the apparatus and displaying the information thereon is connected to the controller 500.

The controller 500 receives droplet discharge status detection signals inputted from the droplet discharge status sensor unit 90. When performing detection of the droplet discharge status, the controller 500 causes the carriage 33 to move to a detection position within a range of the droplet discharge status sensor unit 90, each nozzle 104 of the recording head 34 to sequentially discharge liquid droplets so that the droplet discharge status sensor unit 90 can detect the droplet discharge status of each nozzle. Then, based on the detection result, the controller 500 controls a dummy discharge operation as a maintenance operation of the nozzles 104 of the recording head 34.

The controller 500 further includes an I/F 506 through which data and signals are transmitted between a host and the apparatus. The I/F 506 receives data and signals via a cable or a network from the host 600 including an information processor such as a PC, an image reader such as an image scanner, a picture capturing device such as a digital camera, and the like.

The CPU 501 of the controller 500 reads and analyzes print data in a reception buffer included in the I/F 506, causes the ASICS 505 to perform necessary image processing and data rearrangement processing, and transfers the processed image data from the print controller 508 to the head driver 509. There is provided a printer driver 601 at a side of the host 600. The printer driver 601 generates dot pattern data for outputting an image.

The print controller 508 transmits the above image data as serial data as well as outputs transfer clock signals, latch signals, and control signals necessary to transfer the image data and ensure that the image transfer has been performed, to the head driver 509. The print controller 508 further includes a drive signal generator formed of a D/A converter to perform digital-to-analog conversion of pattern data of drive pulses stored in the ROM, voltage and current amplifiers, and the like. and outputs drive signals formed of a drive pulse or a plurality of drive pulses to the head driver 509.

The drive pulse is a drive signal transmitted from the print controller 508 based on the image data corresponding to one line of data serially input to the recording head 34 which includes a print head 7. The head driver 509 selectively applies the drive pulse to a drive element (for example, a piezoelectric element) that generates energy to cause the print head 7 discharge the ink droplets, thereby driving the print head 7. In this operation, by selecting a drive pulse to formulate a drive signal, dots with various sizes such as a large dot, a medium dot, and a small dot can be selectively shot.

An I/O 513 obtains information from various sensors 515 disposed in the image forming apparatus and extracts necessary information to control the entire printer including the print controller 508, the motor driver 510, and the AC bias power supply 511. The sensors 515 may include an optical sensor to detect a position of the sheet, a thermistor to observe temperature and humidity in the machine, another sensor to observe voltage of the charging belt, and an interlock switch to detect open/close of the cover. The I/O 513 manages information collected from these sensors.

Figure 13:
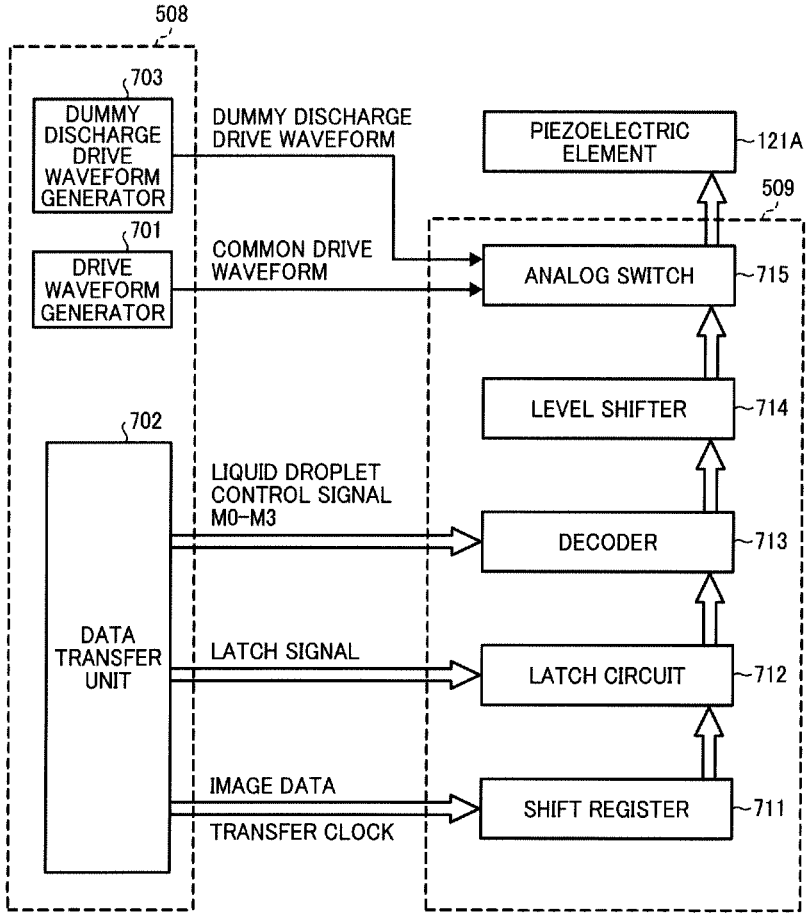
FIG. 13 is a block diagram illustrating a part of printer controller and a head driver in the controller.

Next, an example of the print controller 508 and the head driver 509 will now be described with reference to FIG. 13.

The print controller 508 includes a drive waveform generator 701, a data transfer unit 702, and a dummy discharge drive waveform generator 703. The drive waveform generator 701 generates and outputs a drive waveform (or a common drive waveform) including a plurality of drive pulses or signals during one printing cycle in the image forming operation. The data transfer unit 702 outputs 2-bit image data (gray scale signal 0 or 1), clock signals, latch signals (LAT), and droplet control signals M0 to M3. The dummy discharge drive waveform generator 703 generates and outputs a drive waveform for the dummy discharge.

The droplet control signal is a 2-bit signal to open or close an analog switch 715, a switching means for the head driver 209, for each droplet. The droplet control signal turns to H-level (ON) by a drive pulse or a waveform element to be selected corresponding to the printing cycle of the common drive waveform, and turns L-level (OFF) when the drive pulse or the waveform element is not selected.

A head driver 509 includes a shift register 711, a latch circuit 712, a decoder 713, a level shifter 714, and the analog switch 715. Transfer clock signals (shift clock signals) and serial image data (gray scale data; 2-bit, 1 channel per nozzle) from the data transfer unit 702 are input to the shift register 711. The latch circuit 712 latches each registered value of the shift register 711 by latch signals. The decoder 713 decodes gray scale data and the control signals M0 to M3 and outputs the decoded results. The level shifter 714 converts logic level voltage signals of the decoder 713 to such a level that the analog switch 715 can be operated. The analog switch 715 is opened or closed by an output from the decoder 713 via the level shifter 714.

The analog switch 715 is connected to a selection electrode (individual electrode) 123 of each driven pillar 112A and is input with a common drive waveform from the drive waveform generator 701. Accordingly, when the analog switch 715 is turned on based on the decoded result by the decoder 713 of the serially transferred image data (gray scale data) and control signals MN0 to MN3, a predetermined drive pulse and a waveform element constituting a common drive waveform are selected and applied to the driven pillar 112A, a pressure generating means.

The dummy discharge drive waveform generator 703 generates a dummy discharge drive waveform in the dummy discharge operation and outputs it to the analog switch 715. The common drive waveform from the drive waveform generator 701 and the dummy discharge drive waveform from the dummy discharge drive waveform generator 703 are selectively generated or selectively input to the analog switch 715.

Figure 14:
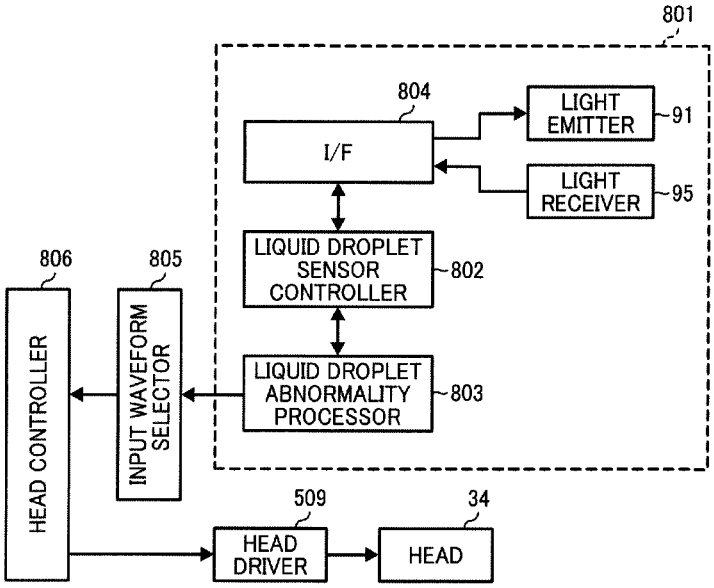
FIG. 14 is a block diagram illustrating a part relating to defective nozzle detection and a maintenance operation in the controller.

Next, detection of a droplet discharge status and a dummy discharge control in the controller will now be described with reference to FIG. 14.

A defective nozzle detection unit 801 includes a liquid droplet sensor unit 802 partly serving as a determining means and a liquid droplet abnormality processor 803, and determines whether any defectively discharging nozzle exists or not.

The liquid droplet sensor unit 802 drives, via an I/F 804, the light emitter 91 to cause the light emitter 91 to emit laser beams as described above and inputs received light output from the light receiver 95 to the liquid droplet abnormality processor 803.

The liquid droplet abnormality processor 803 receives a received light output from the liquid droplet sensor unit 802 and calculates the difference voltage $\Delta V$ corresponding to the droplet volume or the difference time $\Delta t$ corresponding to the droplet speed as described above, and transmits the calculated difference voltage $\Delta V$ or difference time $\Delta t$ to the liquid droplet sensor unit 802. The liquid droplet sensor unit 802 compares the difference voltage $\Delta V$ or the difference time $\Delta t$ with a preset reference threshold and determines whether the discharging from the nozzle is normally performed or defectively performed.

In addition, when determining that there is an abnormal discharge, the liquid droplet sensor unit 802 causes the liquid droplet abnormality processor 803 to output the difference voltage $\Delta V$ or the difference time $\Delta t$ to an input waveform selector 805.

The input waveform selector 805 selects a preset drive waveform for dummy discharging corresponding to the difference voltage ΔV corresponding to the droplet volume or the difference time Δt corresponding to the droplet speed when the liquid droplet sensor unit 802 determines that there is an abnormal discharge, and outputs the drive waveform data to a head controller 806.

The head controller 806 causes the head driver 509 to apply the drive waveform selected by the input waveform selector 805 to the pressure generator of a nozzle of the recording head 34 which is determined to have performed an abnormal discharge and have liquid droplets (i.e., dummy discharge droplets) not contributing image formation discharged from the nozzle.

Figure 15:
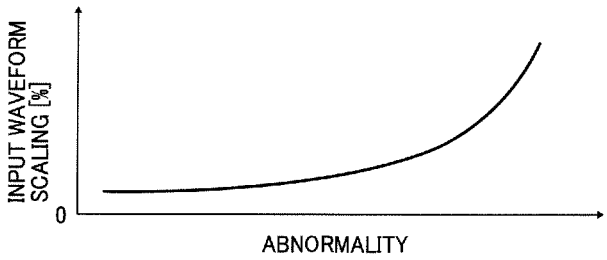
FIG. 15 is a graph illustrating a relation between a droplet speed and dummy discharge drive waveform scaling (input waveform scaling)

Herein, because the difference voltage ΔV or the difference time Δt varies depending on the dryness degree of the ink inside the nozzle as described above, if it is assumed that the abnormality is determined based on the greatness of the difference voltage ΔV or the difference time Δt, as illustrated in FIG. 15, the drive waveform scaling (%) to be applied to the pressure generator of the nozzle is increased as the abnormality degree increases. For example, a drive waveform with a greater potential is applied or a number of discharged droplets is increased.

In the selection of the input waveform for the dummy discharging, the dummy discharge drive waveform generator 703 previously stores drive waveform data including a plurality of dummy discharge drive signals corresponding to the difference voltage ΔV or the difference time Δt. The data transfer unit 702 outputs a droplet control signal for selecting the drive waveform corresponding to the difference voltage ΔV or the difference time Δt from the liquid droplet abnormality processor 803, and the head driver 509 receives the drive waveform corresponding to the difference voltage ΔV or the difference time Δt.

Alternatively, the dummy discharge drive waveform generator 703 may previously store a plurality of dummy discharge drive waveform data corresponding to the difference voltage ΔV or the difference time Δt. The dummy discharge drive waveform data can then be selectively output corresponding to the difference voltage ΔV or the difference time Δt from the liquid droplet abnormality processor 803.

Further alternatively, the dummy discharge drive waveform generator 703 may have pre-stored a plurality of reference dummy discharge drive waveform data and scaling data corresponding to the difference voltage ΔV or the difference time Δt, select a scaling corresponding to the difference voltage ΔV or the difference time Δt from the liquid droplet abnormality processor 803, and correct the reference dummy discharge drive waveform data for output. For example, the dummy discharge drive waveform obtained using 150% of the reference dummy discharge drive waveform data can be applied to the defectively discharged nozzle.

Figure 16:
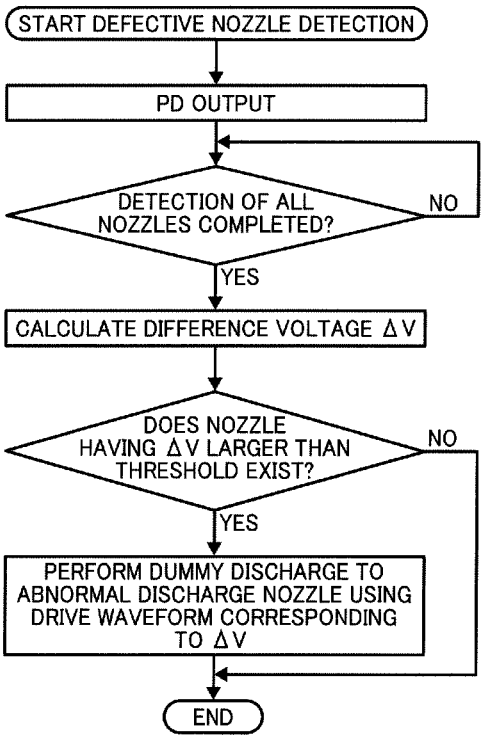
FIG. 16 is a flowchart illustrating a maintenance control (dummy discharge control) in a first embodiment of the present invention.

Next, a maintenance control to appropriately control the dummy discharge according to a first embodiment of the present invention will be described with reference to a flowchart of FIG. 16.

First, a droplet discharge status detecting process (or the defective nozzle detecting operation) is started at a predetermined timing and liquid droplets are discharged from all nozzles and output voltage V1 from the light emitter 95 corresponding to each nozzle is received.

Then, the difference voltage ΔV of the output voltage V1 from the preset normal output voltage V0 corresponding to the normal discharge status is calculated. Upon all calculation of the difference voltage ΔV for all nozzles having been completed, it is determined whether there is a nozzle having a difference voltage ΔV exceeding the preset reference threshold or not. Specifically, a nozzle having the difference voltage ΔV more than the reference threshold is determined to be an abnormally or defectively discharged nozzle.

Herein, if there is an abnormally discharged nozzle having the difference voltage ΔV exceeding the reference threshold, a dummy discharge drive waveform corresponding to the difference voltage ΔV is selected and applied to the pressure generator of the defectively discharged nozzle, and the dummy discharge droplets are discharged from only the defectively discharged nozzle. Further, the selection of the dummy discharge drive waveform can be performed by any method described above.

As described above, the detection result of the droplet discharge status is compared with the reference threshold to determine whether the discharge from the nozzles is performed normally or defectively, the dummy discharge drive waveform corresponding to the difference is output to the pressure generator of the nozzle determined to be defective, and the dummy discharge droplet is discharged only from the nozzle determined to be defective, thereby enabling the waste amount of the consumed liquid droplets in maintenance following the defective droplet discharging to be reduced.

Figure 17:
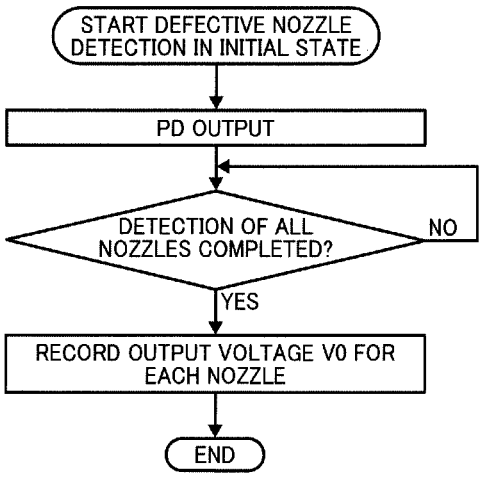
FIG. 17 is a flowchart illustrating a reference threshold setting process in a second embodiment of the present invention.

Next, a second embodiment according to the present invention will be described with reference to FIGS. 17 and 18. FIG. 17 is a flowchart illustrating a reference threshold setting process in the present embodiment, and FIG. 18 is a flowchart illustrating a droplet discharge status detection process (or defective nozzle detection operation).

In the second embodiment, the detection result obtained in the droplet discharge status detection operation in an initial state is used as a reference threshold in comparison with the detection result of the droplet discharge status by the droplet discharge status sensor unit 90.

Specifically, when starting to use the image forming apparatus, an initial filling operation to fill the liquid ink to the recording head 34 or the head tank 35 is performed. Referring to FIG. 17, after the initial filling operation, a droplet discharge status detection operation (or the defective nozzle detecting operation) is started in the initial status, output from the light receiver 95 is obtained, and upon completion of the detecting operation for all nozzles, output voltage from each nozzle is set as a reference threshold being the output voltage V0 and is stored in the nonvolatile memory 504.

Figure 18:
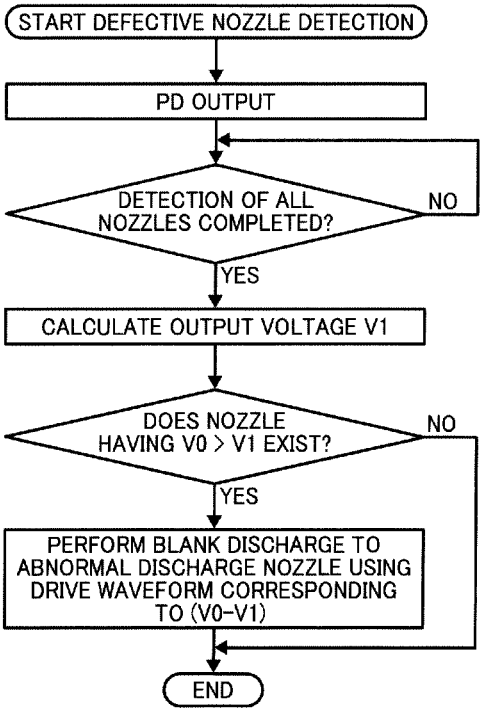
FIG. 18 is a flowchart illustrating a droplet discharge state detection process (defective nozzle detection operation)

Next, as illustrated in FIG. 18, the droplet discharge status detecting process (or the defective nozzle detecting operation) is started at a predetermined timing, output voltage from the light receiver 95 is obtained, and the output voltage V1 is calculated for each nozzle.

Then, the detected output voltage V1 and the stored output voltage V0 are compared and whether the nozzle having V1 satisfying a formula V0>V1 exists or not is determined. Specifically, with the stored output voltage V0 set as the reference threshold, the output voltage V1 is compared with the reference threshold, and the nozzle satisfying V0>V1 is determined to be a defectively discharged nozzle.

If there is an abnormally discharged nozzle with the output voltage V0>V1, the difference voltage ΔV, that is, (V0−V1) is calculated, the dummy discharge drive waveform corresponding to the difference voltage ΔV is selected and applied to the pressure generator of the abnormally discharged nozzle, and the dummy discharge is performed only from the abnormally discharged nozzle. The selection of the dummy discharge drive waveform can be performed by any method described above.

When maintenance is to be performed, a wiper member 84 is caused to flush a nozzle surface of the recording head 34, but due to remaining dust or particles, the nozzle surface will be degraded over time due to repeated recording operations. If the degradation occurs over time, a meniscus cannot be formed on the nozzle surface of the head, leading to a defective discharge. By setting the output voltage V0 in the initial stage as the reference threshold and comparing the detected output voltage V1 with the reference threshold, defective discharge due to degradation over time can be determined.

Figure 19:
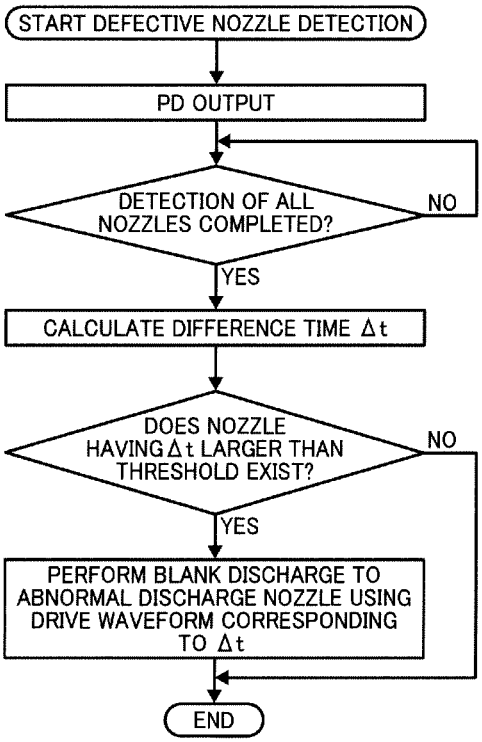
FIG. 19 is a flowchart illustrating a maintenance control (dummy discharge control) in a third embodiment of the present invention.

Next, maintenance control of the dummy discharge according to a third embodiment of the present invention will be described with reference to a flowchart of FIG. 19.

First, a droplet discharge status detecting process (or the defective nozzle detecting operation) is started at a predetermined timing and liquid droplets are discharged from all nozzles and output voltage V1 from the light receiver 95 corresponding to each nozzle is received.

Thereafter, the difference time Δt between the detected interval t1 of the output voltage of an adjacent droplet and a normal detection interval t0 corresponding to the normal discharge status is calculated. Upon all calculation of the difference time Δt for all nozzles having been completed, it is determined whether there is a nozzle having a difference time At exceeding the preset reference threshold or not. Specifically, a nozzle having the difference time Δt more than the reference threshold is determined to be an abnormally or defectively discharged nozzle.

Δt this time, if there is an abnormally/defectively discharged nozzle having a difference time Δt exceeding the reference threshold, a dummy discharge drive waveform corresponding to the difference time Δt is selected and applied to the pressure generator of the defectively discharged nozzle, and the dummy discharge droplets are discharged from only the defectively discharged nozzle. Further, the selection of the dummy discharge drive waveform can be performed by any method described above.

As described above, the detection result of the droplet discharge status is compared with the reference threshold to determine whether the discharge from the nozzles is performed normally or defectively, the dummy discharge drive waveform corresponding to the difference is output to the pressure generator of the nozzle determined to be defective, and the dummy discharge droplet is discharged only from the nozzle determined to be defective, thereby enabling to reduce a waste amount of the consumed liquid droplets in maintenance following the defective droplet discharging.

Figure 20:
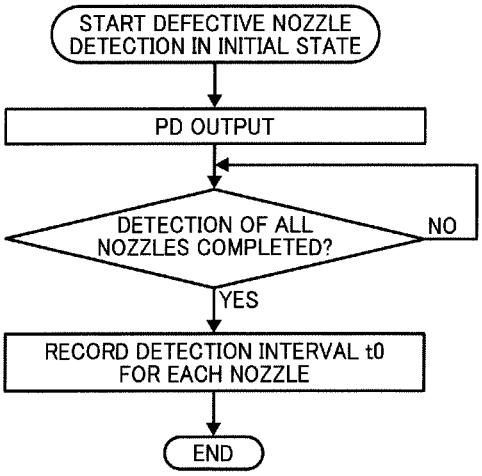
FIG. 20 is a flowchart illustrating a reference threshold setting process in a fourth embodiment of the present invention.

Next, a fourth embodiment according to the present invention will be described with reference to FIGS. 20 and 21. FIG. 20 is a flowchart illustrating a reference threshold setting process in the present embodiment, and FIG. 21 is a flowchart illustrating a droplet discharge status detection process (or defective nozzle detection operation).

In the present embodiment, the detection result obtained in the droplet discharge status detection operation in the initial condition is used as a reference threshold to be compared with the detection result of the droplet discharge status by the droplet discharge status sensor unit 90.

Specifically, when starting to use the image forming apparatus, an initial filling operation to fill the liquid ink to the recording head 34 or the head tank 35 is performed. Referring to FIG. 20, after the initial filling operation, a droplet discharge status detection operation (or the defective nozzle detecting operation) is started in the initial status, output from the light receiver 95 is obtained, and upon completion of the detecting operation for all nozzles, detection interval t0 of each nozzle with an adjacent nozzle is stored in for example the nonvolatile memory 504.

Figure 21:
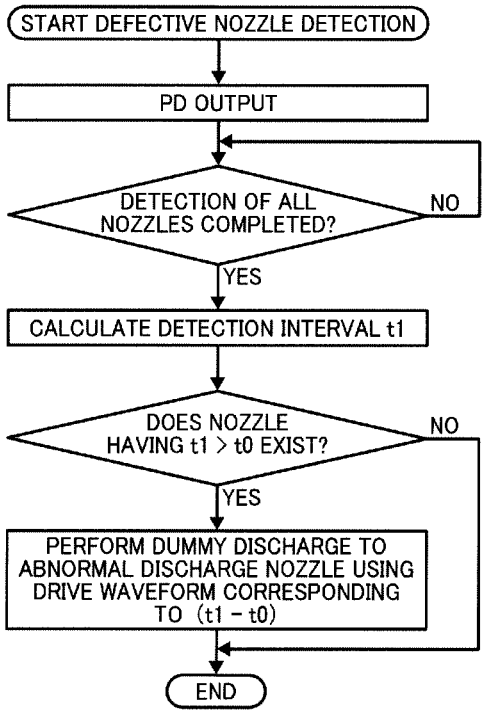
FIG. 21 is a flowchart illustrating a droplet discharge state detection process (defective nozzle detection operation)

Next, as illustrated in FIG. 21. the droplet discharge status detecting process (or the defective nozzle detecting operation) is started at a predetermined timing, output from the light receiver 95 is obtained, and the detection interval t1 for each nozzle is calculated.

Then, the detected detection interval t1 and the stored detection interval t0 in the initial status are compared and whether the nozzle having t1 satisfying a formula t1>t0 exists or not is determined. Specifically, the stored detection interval t0 set as the reference threshold is compared with the detected interval t1, and the nozzle satisfying t1>t0 is determined to be a defectively discharged nozzle.

When there is a nozzle satisfying t1>t0, that is, an abnormally/defectively discharged nozzle, the difference time Δt of (t1−t0) is calculated, a dummy discharge drive waveform corresponding to the difference time Δt is selected and applied to the pressure generator of the defectively discharged nozzle, so that the dummy discharge droplets are discharged from only the defectively discharged nozzle. Further, the selection of the dummy discharge drive waveform can be performed by any method described above.

When maintenance is to be performed, a wiper member 84 is caused to flush a nozzle surface of the recording head 34, but due to remaining dust or particles, the nozzle surface will be degraded over time due to repeated recording operation. If the degradation occurs over time, a meniscus cannot be formed on the nozzle surface of the head, which may lead to a defective discharge. By setting the detection interval t0 in the initial stage as the reference threshold, and by comparing the detected interval t1 with the reference threshold, defective discharge due to degradation over time can be determined.

Figure 22:
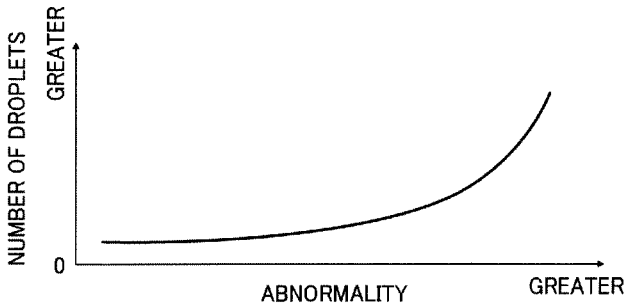
FIG. 22 is a graph illustrating a fifth embodiment of the present invention.

Next, a fifth embodiment according to the present invention will be described with reference to FIG. 22. FIG. 22 is an explanatory view for explaining the fifth embodiment of the present invention.

In the fifth embodiment, a number of droplets of the dummy discharging is changed due to the difference voltage ΔV or the difference time Δt. Specifically, as described above, the greater the dryness degree becomes, the smaller the droplet volume or the droplet speed becomes in performing the defective nozzle detection. As illustrated in FIG. 21, as the abnormality increases (or as the droplet volume is being lessened or as the droplet speed is being slowed), the number of the droplets for dummy discharging is increased.

With this configuration, the nozzle can be returned to normal operating status quickly.

Figure 23:
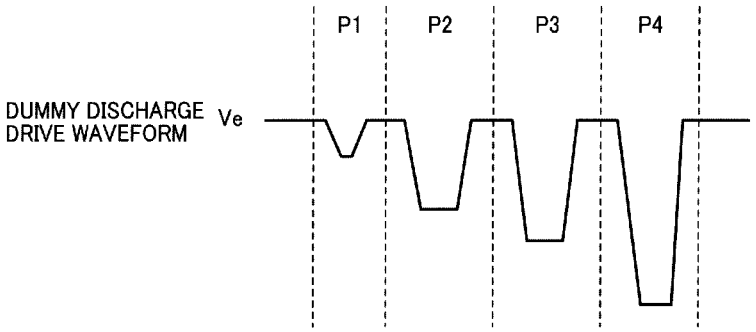
FIG. 23 shows a dummy discharge drive waveform.

Next, an example of a dummy discharge drive waveform will be described with reference to FIG. 23.

The dummy discharge drive waveforms include a micro-drive pulse or signal P1 to cause ink in the vicinity of the nozzle to vibrate but not allowing the liquid droplet to be discharged, followed by three types of dummy discharge pulses or signals P2 to P4, in one drive cycle. The dummy discharge pulses P2 to P4 are pulses sequentially increasing in electric potential. It is preferable to select and apply the dummy discharge pulse P2 to the pressure generator when the difference voltage ΔV or the difference time Δt is small. As the difference voltage ΔV or the difference time Δt is becoming greater, the dummy discharge pulse P3 or P4 is selected and applied to the pressure generator.

Further, when the difference voltage ΔV or the difference time Δt is greater, a plurality of dummy discharge pulses can be selected from the dummy discharge pulses P2 to P4 so that the number of droplets to be discharged as a dummy discharge can be increased.

Concerning the nozzle determined to be normal, the microdrive pulse P1 is applied so that the optimal nozzle status can be maintained.

The operation according to the present embodiment such as the maintenance control and the droplet discharge status detection process and the like may be executed by a computer executing a program stored in the ROM 502 according to the present invention. The program can be installed in the image forming apparatus by downloading to the host computer 600 as an information processor. The above processing can be performed by a printer driver of the host computer 600 serving as the information processor. In addition, by using the image forming apparatus according to the present embodiment and an information processor or the image forming apparatus and an information processor having a program enabling processing according to the present invention to perform in combination, an image forming system may be configured.

In this patent specification, "sheet" is not limited to the paper material, but also includes an OHP sheet, fabrics, boards, etc., on which ink droplets or other liquid are deposited. The term "sheet" is a collective term for a recorded medium, recording medium, recording sheet, and the like. "Image formation" means not only recording, but also printing, image printing, and the like.

The term "image forming apparatus" means a device for forming an image by impacting ink droplets to media such as paper, thread, fiber, fabric, leather, metals, plastics, glass, wood, ceramics, and the like. "Image formation" means not only forming images with letters or figures having meaning to the medium, but also forming images without meaning such as patterns to the medium (and impacting the droplets to the medium).

The ink is not limited to so-called ink, but means and is used as an inclusive term for every liquid such as recording liquid, fixing liquid, and aqueous fluid to be used for image formation, which further includes, for example, DNA samples, registration and pattern materials and resins.

The term "image" is not limited to a plane two-dimensional one, but also includes a three-dimensional one, and the image formed by three-dimensionally from the 3D figure itself.

Further, the image forming apparatus includes, otherwise limited in particular, any of a serial-type image forming apparatus and a line-type image forming apparatus.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a recording head including a plurality of nozzles and a pressure generator to generate a pressure to cause the nozzles to discharge liquid droplets;

a droplet discharge status sensor unit provided outside the recording head to detect a droplet discharging status by detecting, for each nozzle of the recording head, a droplet discharged from the nozzle; and a maintenance controller to control a maintenance operation by a dummy discharge of quid droplets not contributing to image formation, wherein:

the droplet discharge status sensor unit includes;

a light emitter to emit a light beam;

a collimated lens to collect the light beam emitted from the light emitter and diffused by liquid droplets discharged from the recording head; and a light receiver to receive the diffused light beam to convert the diffused light beam into an actual voltage output;

when the difference voltage exceeds the preset reference threshold, the droplet discharge status sensor determines that the nozzle is a defectively discharged nozzle and when the difference voltage is within the preset reference threshold, the droplet discharge status sensor determines that the nozzle is a normally discharged nozzle;

the maintenance controller outputs a dummy discharge drive waveform corresponding to the difference voltage, to the pressure generator to cause the defectively discharged nozzle to discharge droplets for dummy discharging;

a number of lets dischaned during the dummy discharge is varied and corresponds to the difference voltage or to a difference time between a detected droplet speed and a reference threshold; and the dummy discharge is performed during the maintenance operation, only to a nozzle determined to be the defectively discharged nozzle.

2. An image forming apparatus as claimed in claim 1, wherein the droplet discharge status sensor unit detects a droplet volume of the discharged liquid droplets.

3. An image forming apparatus as claimed in claim 2, wherein the detection result of the droplet volume in an initial droplet discharge status sensing operation is set to the reference threshold.

4. An image forming apparatus as claimed in claim 1, wherein the droplet discharge status sensor unit detects a droplet speed of the discharged liquid droplets.

5. An image forming apparatus as claimed in claim 4, wherein the detection result of the droplet speed in an initial droplet discharge sensing operation is set to the reference threshold.

6. The image forming apparatus as claimed in claim 1, wherein the pressure generator comprises a piezoelectric element.

7. A maintenance method for an image forming apparatus, the image forming apparatus comprising:

a recording head including a plurality of nozzles and a pressure generator configured to generate a pressure to cause the nozzles to discharge liquid droplets;

a droplet discharge status sensor unit provided outside the recording head to detect, for each nozzle of the recording head, droplets discharged from the nozzle, the droplet discharge status sensor unit including:

a light emitter to emit a light beam;

a collimated lens to collect the light beam emitted from the light emitter and diffused by liquid droplets discharged from the recording head;

a light receiver to receive the diffused light beam to convert the diffused light beam into an actual voltage output; and a controller to execute a dummy discharge of liquid droplets not contributing to image formation to clear the nozzles of the recording head, wherein the maintenance method comprises the steps of:

detecting one of the volume and speed of droplets discharged from each nozzle of the recording head using the droplet discharge status sensor unit;

comparing detection readings obtained by the droplet discharge status sensor unit and the preset reference threshold using the controller;

identifying a nozzle that is a defectively discharged nozzle based on the comparison; and outputting a dummy discharge drive waveform corresponding to a difference between a detected volume or speed of the discharged droplet and the preset reference threshold, to a nozzle identified as a defectively discharged nozzle to cause the defectively discharged nozzle to discharge droplets for dummy discharge to clear the nozzle;

calculating a difference voltage between the actual voltage output and a normal voltage output, comparing the difference voltage with a preset reference threshold value based on a permissible range of fluctuation in droplet volume, and determining whether the nozzle is a normally discharged nozzle or a defectively discharged nozzle; and determining, when the difference voltage exceeds the preset reference threshold that the nozzle is a defectively discharged nozzle;

determining, when the difference voltage is within the preset reference threshold that the nozzle is a normally discharged nozzle;

wherein a number of droplets discharged during the dummy discharge is varied and corresponds to the difference between the detected volume or speed of the discharged droplet and the preset reference threshold; and wherein the dummy discharge is performed during the maintenance operation only to a nozzle determined to be the defectively discharged nozzle.

8. An image forming apparatus comprising:

a recording head including a plurality of nozzles and a pressure generator to generate a pressure to cause the nozzles to discharge liquid droplets;

a maintenance mechanism to maintain the nozzles of the recording heads in good operating condition;

a conveyer to convey a sheet to a position facing the recording head;

a droplet discharge status sensor unit to detect a droplet discharging status by detecting, for each nozzle of the recording head, a droplet discharged from the nozzle, and determining whether the nozzle is a normally discharged nozzle or a defectively discharged nozzle; and a maintenance controller to control a maintenance operation by a dummy discharge of liquid droplets not contributing to image formation, wherein:

the droplet discharge status sensor unit is disposed outside of the recording head and disposed between the maintenance mechanism and the conveyor; and the dummy discharge operation is performed in maintenance only to a nozzle determined to be a defectively discharged nozzle.

* * * * *